United States Patent [19]

Sommer

[11] Patent Number: 4,781,543

[45] Date of Patent: Nov. 1, 1988

[54] ARTIFICIAL LIFT SYSTEM FOR OIL WELLS

[75] Inventor: Gordon M. Sommer, Boca Raton, Fla.

[73] Assignee: 501 Stripper Production Systems, Inc., Boca Raton, Fla.

[21] Appl. No.: 6,876

[22] Filed: Jan. 27, 1987

[51] Int. Cl.[4] ..... F04B 47/08

[52] U.S. Cl. ..... 417/378

[58] Field of Search ..... 417/378, 383, 392, 388, 417/385, 387, 377

[56] References Cited

U.S. PATENT DOCUMENTS

| | | | |
|---|---|---|---|
| 1,694,583 | 12/1928 | Conklin | 417/392 |
| 2,251,290 | 8/1941 | Reed | 417/401 |
| 2,752,854 | 7/1956 | Prior et al. | 417/388 |
| 3,123,007 | 3/1964 | Orr | 417/383 |
| 4,304,531 | 12/1981 | Fisher | 417/388 |
| 4,600,368 | 7/1986 | Sommer | 417/378 |

OTHER PUBLICATIONS

Guiberson Operations, Dresser Industries General Catalogue, Bul. No. H-P1027-74, pp. 1602-1606, 1640, 1641, date unknown.

*Primary Examiner*—Leonard E. Smith

*Attorney, Agent, or Firm*—Oltman and Flynn

[57] ABSTRACT

Oil is recovered from underground formations more efficiently by the use of a subsurface power piston that reciprocates a subsurface pump. A series of connecting rods called sucker rods connects the power piston to the subsurface pump. The subsurface power piston is driven upward by a surface mounted hydraulic actuation system. The power piston and sucker rod travel downward by the force of gravity. The distance between the subsurface pump and power piston is set so the pressure at the depths of the power piston and pump closely counterbalance the weight of the sucker rod string at all positions of stroke with a slight down bias. The free-body piston of the surface actuator acts as a membrane member between the refined oil of the surface actuation system and the fluid being recovered. The pumping action occurs on the downstroke of the subsurface equipment. The pumping speed is automatically and optimally adjusted according to fluid parameters. The upstroke speed can be different from the downstroke speed for increased production. The time between the pressure pulses to the power piston is easily adjusted to reduce sucker rod oscillation and stresses, and to control the time between pump cycles.

19 Claims, 6 Drawing Sheets

ARTIFICIAL LIFT SYSTEM FOR OIL WELLS

FIELD OF THE INVENTION

The present invention relates to improvements in the pumping or lifting of fluids from underground formations including oil wells.

BACKGROUND OF THE INVENTION

The method of artifically lifting fluid from underground formations used in the vast majority of oil wells has changed little since the earliest history of the petroleum industry. The conventional method uses a surface mounted mechanical system generally referred to as a pump-jack or walking beam. The mechanical drive system imparts a vertical reciprocating motion to the sucker rod string that is connected to the subsurface pump at the formation.

Considerable refinement of the components has occurred through the years including improved metallurgy that enables them to operate reliably. In spite of these improvements, the pump-jack system has certain inherent limitations which has inspired others to attempt devising better methods of artificial lift. To the best of my knowledge none of these alternate systems has achieved much commercial success. Some of the limitations of the conventional pump-jack, sucker rod systems are as follows:

1. High energy requirements. This is a result of using a counterweight on one of the rotary members of the pump-jack to counterbalance the weight of the sucker rod string that results in considerable unbalanced forces and thus energy to reciprocate the sucker rod string.
2. High stresses in sucker rod string. The diameter of the sucker rods selected in any installation is relatively small to minimize the unbalanced forces. This results in sucker rod string stresses as high as 28,000 pounds per square inch in many instances.
3. Oscillation and harmonics in sucker rod string. This results from the high stresses used and the high speed reversal of the string due to the simple harmonic motion imparted by the pump-jack. The hgh stress reversals often cause the string to part and require the sucker rod string and subsurface pump to be pulled using a fishing tool.
4. Size and weight of pump-jack. The pump-jack requires expensive foundations thus limiting where they can be installed due to visual pollution, value of surface real estate, irrigation of surface crops and vandalism. Their size also limits how close together the units can be installed.
5. Fixed pumping rate. In order to reduce the fixed production rate of a conventional pump-jack, the pump-jack is periodically stopped. This is often necessary in a stripper well where only a limited amount of production fluid remains in the well. This stopping time can often be as much as 8 or more hours out of 24. It causes the settling of sand and the like in the subsurface pump. Pulling the subsurface pump for cleaning adds to the cost of operating the well.
6. Downstroke is the same speed as upstroke. The speed of the downstroke is limited by the viscosity of the fluid in the formation. This limits the production rates possible.

SUMMARY OF THE INVENTION

The object of the present invention is to eliminate the use of a surface mounted pump-jack for oil wells by using a very small actuator and hydraulic pumping system.

Another object of the present invention is to provide a membrane object to separate the closed circuit hydraulic pumping system and the fluid from the formation.

Another object of the present invention is to provide a subsurface power piston that is connected to a subsurface pump by standard sucker rods so forces on the upstroke and downstroke of the power piston can be closely balanced by the pressure of the downhole fluid. The power piston thus significantly reduces the energy consumption needed to oscillate the sucker rod.

Another object of the present invention is to provide a means by which the pumping rate of the subsurface pump can be easily changed to suit the flow conditions of the formation, thus preventing sand and the like contained in production fluid from settling in the fluid column.

Another object of the present invention is to provide a means to automatically adjust the speed of the downstroke to be different from the speed of the upstroke to suit formation fluid characteristics.

Another object of the present invention is to efficiently lift the power piston by forcing production fluid under it.

Other objects of this invention will appear from the following description and appended claims, reference being had to the accompanying drawings forming a part of this specification wherein like reference characters designate corresponding parts in the several views.

The complete system is composed of four (4) basic assemblies. The hydraulic actuation system and actuator are mounted on the surface and the power piston and pump are mounted subsurface.

The actuator has a free-body piston which acts as a membrane to keep the production fluid separate from the refined oil used in the closed circuit actuation system.

The hydraulic actuation system is used to provide pressure pulses to one side of the free-body piston incorporated in the actuator. The other side of the free-body piston pushes against production fluid from the formation and provides pressure pulses to the underside of the subsurface power piston. The volume of production fluid displaced by the pressure pulse is determined by the displacement of the subsurface power piston and the expansion of the production tubing in the well down to the level of the power piston. The time between these pressure pulses is calculated based on formation parameters. For maximum production, the off-time is just enough to allow the assembly consisting of the power piston, the sucker rod string and the subsurface pump to travel downward by the force of gravity to the bottom position added to the time for the sucker rod stresses to settle to their static stress level. A dashpot assembly is incorporated in the power piston assembly to decelerate the downward travel of the power piston from a point near the bottom of the stroke. The off-time is increased from this minimum setting to decrease the production rate of the well. The timing function is controlled by an adjustable solid state sequence timer.

The power piston is used to raise the sucker rod string and the subsurface pump. It is mounted only a portion of the distance to the formation depth. This distance is dependent upon the depth of the formation, specific gravity of the production fluid, the amount of water contained in the production fluid, the gas pressure in the well between the production tubing and casing, and the diameter of the sucker rods. The actual distance used in any installation is calculated for maximum efficiency and is usually about 25–30 percent of the depth of the formation.

For an understanding of how the equipment operates, it must be recognized that the top side of the power piston is vented to the outside of the production tubing and the only down force pushing down the top of the power piston is well-gas pressure if any is present. The natural upward force of the power piston is caused by the pressure of the production fluid that results from the depth of the power piston times the net area of the power piston. This net area is defined by the diameter of the power piston and the outside diameter of the tubing attached to the lower end of the power piston.

Assume that the subsurface equipment is at the top of its stroke. (The actuator is at the bottom of its stroke). The weight of the sucker rod string is such that the sucker rod string provides a positive downward force against the natural upward force of the power piston. The moment the subsurface equipment starts the down stroke, two travelling valve sets on the sucker rod string open and a standing valve set closes on the production tubing. This causes well depth pressure to be transferred to a chamber between the lower travelling valve and the standing valve. This causes extra upward force equal to the depth pressure times the area of the plunger of the subsurface pump. The net area of the power piston, the sucker rod string weight, and diameter of the plunger are such that a small but positive downward force is acting upon the assembly. Pumping of the production fluid to the surface occurs during the downstroke. The total production fluid pumped to the surface equals the total of the displacement of the power piston plus the displacement of the subsurface pump plunger. Since production fluid volume equivalent to the displacement of the power piston had previously been pumped down to the well, the net amount of fluid pumped to the surface each cycle of the assembly is the displacement of the subsurface pump plunger. The upstroke is caused by a pressure pulse from the surface mounted actuator. The amount of fluid pumped subsurface by the actuator is equal to the net displacement of the power piston plus the expansion of the production tubing down to this depth. The production fluid is pumped down the fluid column to the top of the power piston assembly. It then enters an annulus between the inner and outer tubes of the power piston assembly and travels to the bottom side of the power piston. Both travelling valves close on the upstroke. The top travelling valve blocks the pressure from the actuator so the production tubing between the power piston and the subsurface pump remain at depth pressure. The standing valve is open on the upstroke and allows production fluid from the formation into a cavity at the bottom of the subsurface pump. BRIEF DESCRIPTION OF THE DRAWINGS FIG. 1 shows a sectional view of an oil well with the present invention installed therein.

FIG. 2 shows a schematic of the above-ground hydraulic action system.

FIG. 2*a* shows an alternate hydraulic actuation system.

Before explaining the disclosed embodiments of the present invention in detail, it is to be understood that the invention is not limited in its application to the details of the particular arrangements shown, since the invention is capable of other embodiments. For example, the subsurface pump shown in the present invention can be replaced by an API (American Petroleum Institute) standard pump model number RWBC (rod, stationary thin wall barrel, bottom anchor). The power piston can be constructed using standard API soft-packed plungers and barrels. Likewise, the travelling and standing valves can be of API standards. Also, a standard API seating assembly can be used. Also, the terminology used herein is for the purpose of description and not of limitation.

DETAILED DESCRIPTION

Figure 1:
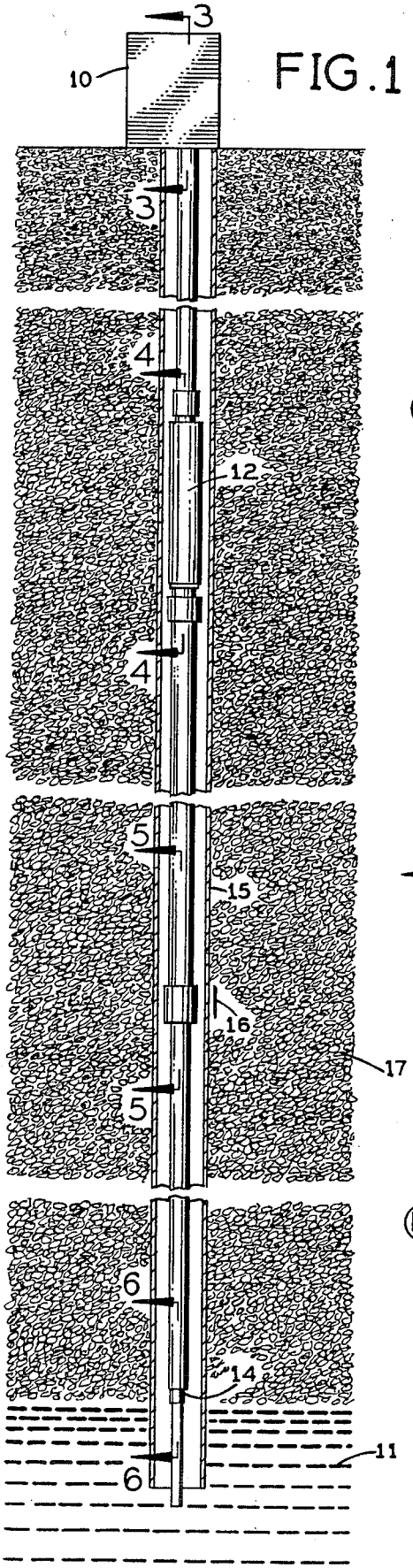
Figure 2:
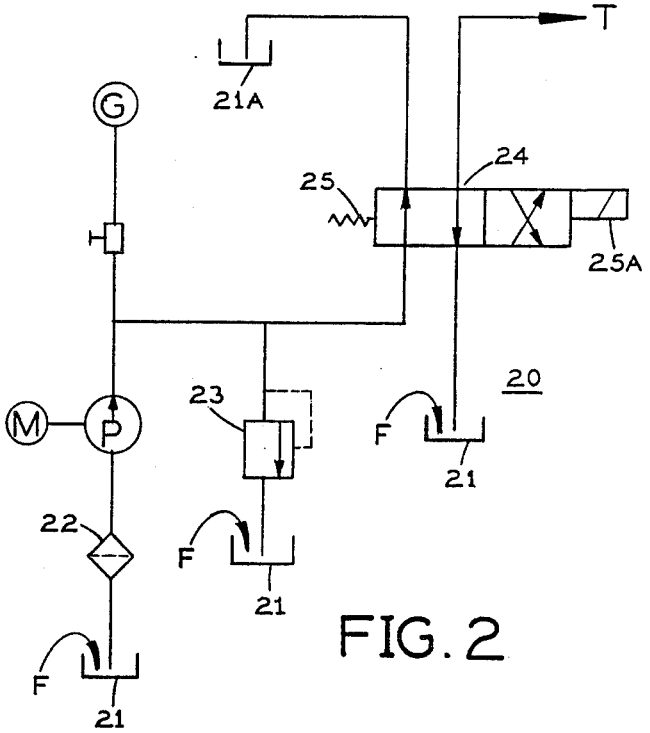

Referring first to FIGS. 1 and 2, the present invention is comprised of four basic modules. The hydraulic actuation system 20 powers the actuator 10. The actuator 10 forces production fluid 11 back down the production tubing to the power piston assembly 12 which raises the sucker rod string 450 and the subsurface pump plunger 440 (see FIGS. 4, 5) by increasing the pressure in the column of top travelling valve 446. The complete assembly (440, 450, 442) is then allowed to travel downward by the force of gravity for a distance equal to the travel of the power piston. This downward travel of the assembly (440, 450, 442) causes the opening of the travelling valves 446 in the power piston assembly 12 and the subsurface pump 14. It also closes the standing valve 600. This forces the production fluid 11 that was previously pumped to the power piston 442 on the upstroke along with the production fluid 11 displaced by the subsurface pump 14 toward the surface. In summary, the four basic modules are the hydraulic actuation system 20, the actuator 10, the power piston assembly 12 and the subsurface pump assembly 14. The present invention can be used efficiently for recovering oil from formations 500 feet to 8000 feet and deeper.

As is customary in most installations, casing 15 maintains the integrity of the drilled hole. Significant amounts of gas, water, sand and the like may be present in the production fluid 11. Drill hole 16 has previously been dug into dirt 17 in order to reach the productions fluid 11. FIG. 2 is a schematic of the above ground hydraulic actuation system 20. The reservoir 21 contains refined hydraulic oil F, and passes through strainer 22 on the inlet side of the hydraulic pump P. The driving motor M rotates the commercial positive displacement pump at a fixed speed. Relief valve 23 controls the maximum pressure in the system and is set to a predetermined pressure that will give a small but positive upward force to the subsurface assemblies. The gauge G indicates the pressure setting. Valve 24 is a standard 4-way solenoid operated-spring return valve. It has two positions. The position shown for the valve spool (not shown) of the valve is caused by springs 25. The oil from the pump P is returned to the reservoir 21A when the spool is in this position. Energizing the solenoid 25A shifts the valve 24 so the oil from the pump P is directed to the above ground actuator from the point T. An electronic sequence timer (not shown) controls when valve 24 is energized and deenergized.

Figure 3:
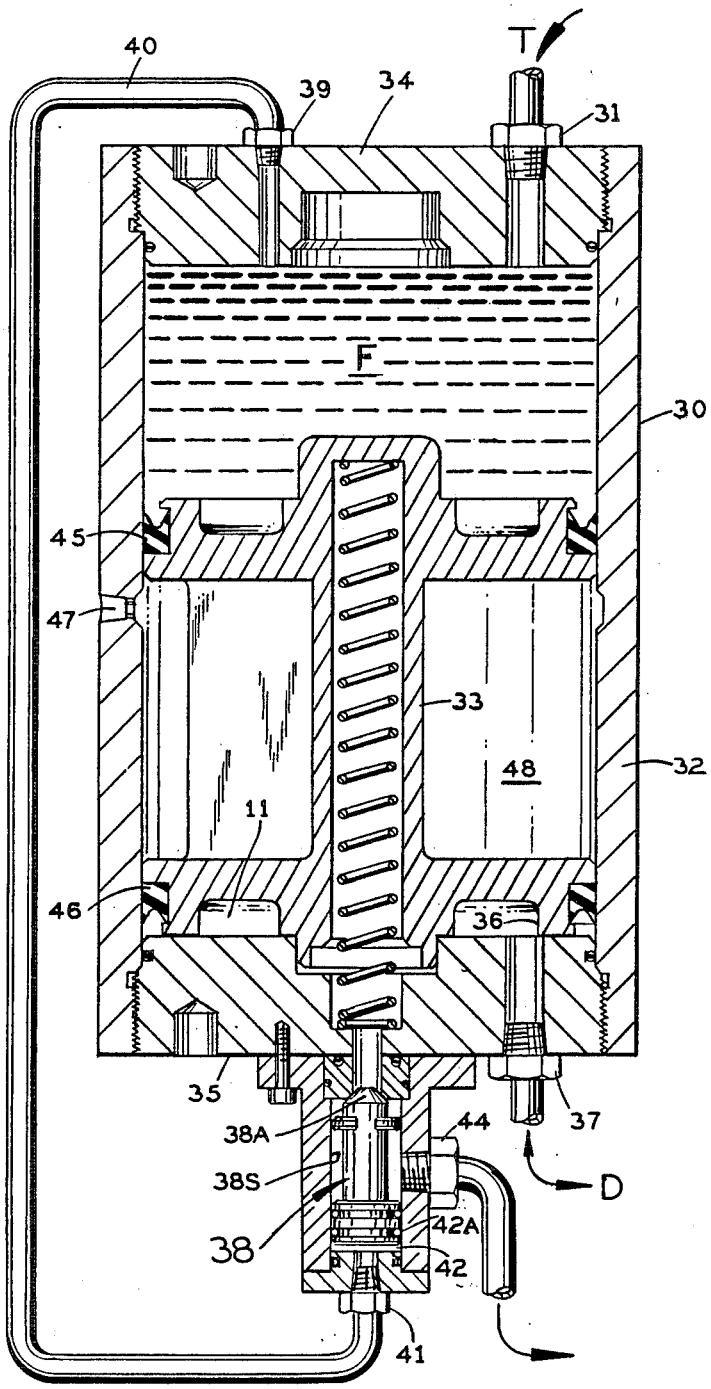
FIG. 3 shows a sectional view of the above-ground actuator taken along line 3—3 of FIG. 1.

FIG. 3 shows how the oil F from the hydraulic actuation system enters actuator 30 through port 31. Actuator 30 is comprised of outer cylinder 32 which houses piston 33. Actuator top 34 and bottom 35 complete a sealed container housing the double ended, free body piston 33. When the valve 24 (FIG. 2) is energized, the piston 33 is forced downward. Spring 33A returns the piston 33 to its top position when valve 24 is deenergized. The downward movement of piston 33 forces production fluid 11 from the bottom side of the piston 33 out through port 37 under the pressure D required to lift the subsurface assemblies. The pressure from the top side of piston 33 on the downstroke is transferred to the cavity below spool 38S via port 39, tubing 40 and port 41. The lower portion of spool 38S consists of a piston 38 whose diameter is larger than the effective diameter of seat 38A. This keeps production fluid 11 from escaping through port 44. On the piston 33 upstroke, production fluid 11 flows into the chamber 36 below the piston. Since there is now no pressure in cavity 42, the flow of oil F opens spool 38S and the production fluid 11 being pumped to the surface that is not required to fill the cavity 36 when piston 33 is at the top of its stroke flows to a production fluid holding tank (not shown). The distance between packings 45 and 46 is greater than the stroke of piston 33. Additionally cylinder 32 has outlet port 47 that is positioned at the mid-point of the sroke of piston 33. This port is incorporated to drain any fluid leakage past packings 45 and 46. Port 47 and the fact that packings 45 and 46 travel on different portions of inner wall of cylinder 32 eliminates any contamination of the refined oil F in the actuation chamber 48. Likewise the two "O" rings 42A are disposed by a distance greater than the stroke of spool 42 to further eliminate contamination of the refined oil F. This use of an actuator 10 eliminates the need to directly pump production fluid 11. The use of piston 33 as a membrane member to isolate the two fluids F and 11 is one important aspect of the present invention.

Figure 4:
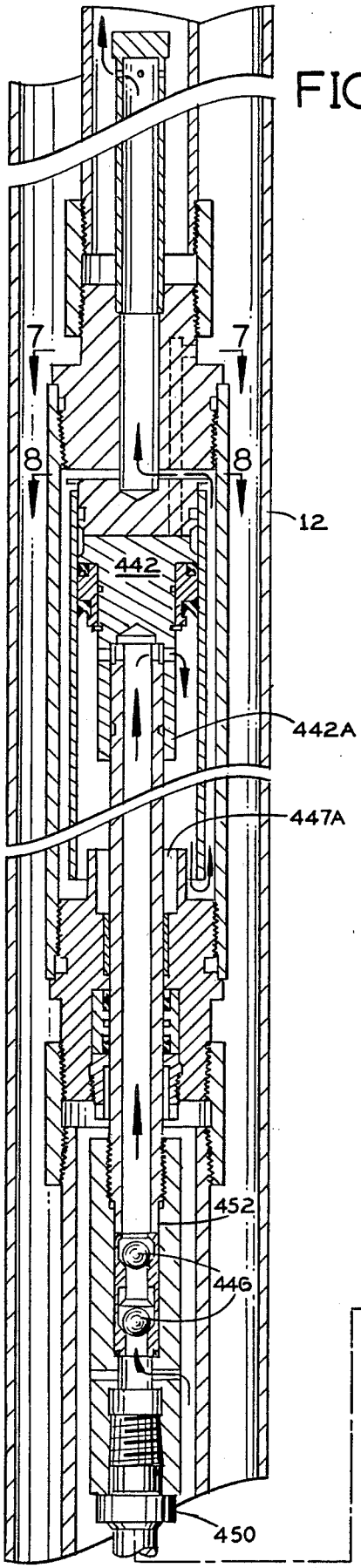
FIG. 4 shows a sectional view of the subsurface power piston assembly taken along line 4—4 of FIG. 1. The power piston is in the up position.

FIG. 4 shows the sectional view of the subsurface power piston assembly 12. This is another important element of the present invention. The piston assembly 12 is located a portion of the depth of the fluid formation. Its specific depth in any installation is dependent upon well parameters but is usually about 25–30 percent of the depth at which the subsurface pump 14 is affixed. The power piston 442 is connected by sucker rods 450 to the subsurface pump 440. Lifting of production fluid 11 occurs when this assembly (440, 450, 442) travels downward by gravity for a distance determined by the stroke length of power piston 442 and is decelerated at the bottom of its stroke by the dashpot defined by cavity 447A and power piston extension 442A. Power piston tube 451 is connected to piston 442 which is connected to coupling 452. Coupling 452 contains the upper or power piston travelling valves 446. Coupling 452 is connected to the top end of the sucker rod string 450 that consists of standard sucker rods.

Figure 5:
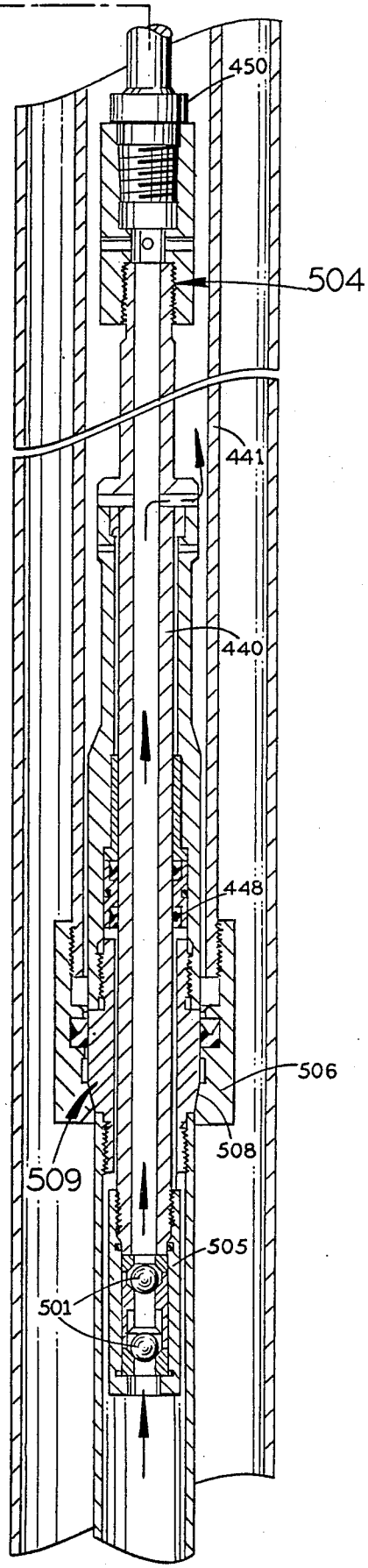
FIG. 5 shows a sectional view of the subsurface pump taken along line 5—5 of FIG. 1.

FIG. 5 shows the sectional view of the subsurface pump assembly 14. The bottom end of sucker rod string 450 is connected to coupling 504. This is connected to tube 440 which is the plunger of the subsurface pump assembly 14. The bottom or pump travelling valves 501 are contained in coupling 505 attached to the bottom end of tube 440. Packings 448 are used to seal the production fluid above these packings from production fluid 11 below them when the assembly is on the upstroke and travelling valves 501 are closed. Coupling 506 is attached to the bottom end of production tubing 441. It contains a tapered seat 508 that mates with a like seat on adaptor 509. Coupling 506 also contains a packing that mates with a cylindrical surface adaptor (not shown). This assembly (506, 508, 509) supplies support for said pump assembly 14 and seals the production fluid 11 in the fluid column. It is constructed in such a way that after the production tubing 15 above the power piston 442 has been pulled and the power piston 442 removed, no further production tubing 441 need be pulled to pull the sucker rod string 450 and the subsurface pump 14 including standing valve 600 (see FIG. 6).

Computer simulations indicate that the operating efficiency increases as the separation between the subsurface pump 14 and the subsurface power piston 442 increases. This requires using smaller diameter sucker rods 450 for a given net area of the power piston 442. These simulations also show that the power required to recover a barrel of production fluid 11 with the present invention is only 20–25 percent of the power required using the conventional pump-jack. This is true even when selecting sucker rod diameters that limit stresses to approximately 14,000 pounds per square inch or approximately one-half that encountered with the pump-jack system. The use of tapered sucker rod strings is desirable for deep formations to further enhance efficiency. (A tapered sucker rod string is a string of sucker rods in which the size of the sucker rods is reduced as it extends from the power piston 442 to the subsurface pump 14).

Figure 6:
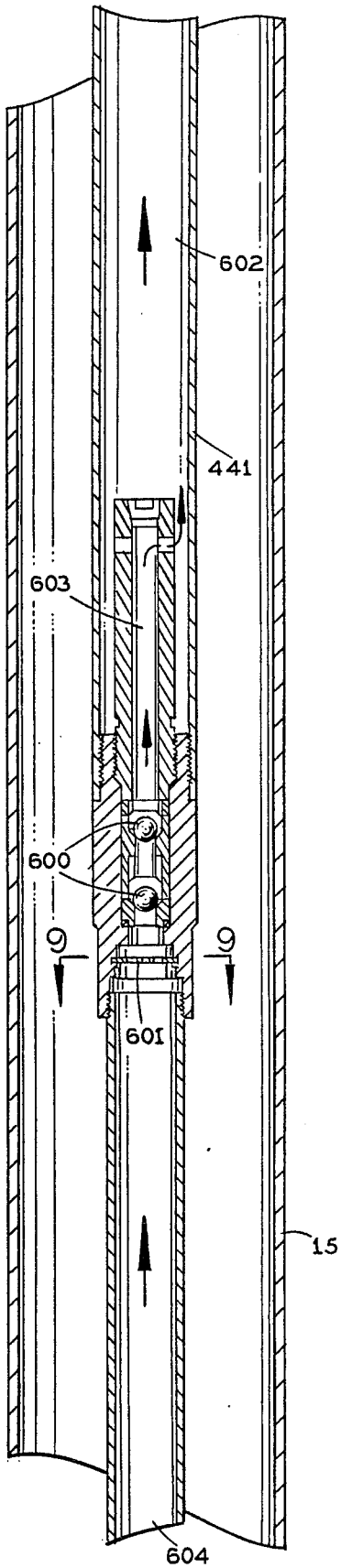
FIG. 6 shows a sectional view of the standing valve set that is part of the subsurface pump taken along line 6—6 of FIG. 1.

FIG. 6 shows the pump assembly 14. However, the real pumping force comes from the falling sucker rod 450 shown in FIG. 5. On the downstroke of sucker rod 450 standing valves 600 close. This forms a closed container in chambers 602 and 603. The falling sucker rod 450 forces the production fluid 11 trapped inside chambers 602 and 603 to rise up the center of sucker rod 450 as described above in FIGS. 4 and 5. On the upstroke of sucker rod 450 standing valves 600 open and production fluid 11 is sucked up through strainer 601 into a vacuum created in chambers 602 and 603. Orifice 604 is at the bottom of the well surrounded by production fluid 11.

Figure 7:
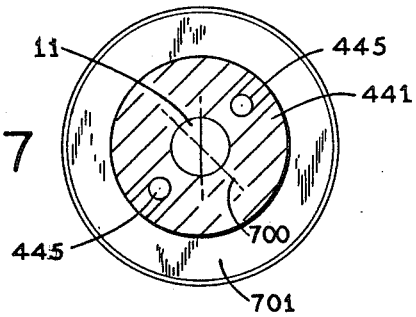
FIG. 7 shows a cross-sectional view of the top head of the power piston assembly showing the vent holes from the top of the power piston to the annulus between the production tubing and casing. It is taken along line 7—7 of FIG. 4.

FIG. 7 shows vent holes 445 in production tube 441. Production fluid 11 flows up chamber 700. Chamber 701 is filled with air.

Figure 8:
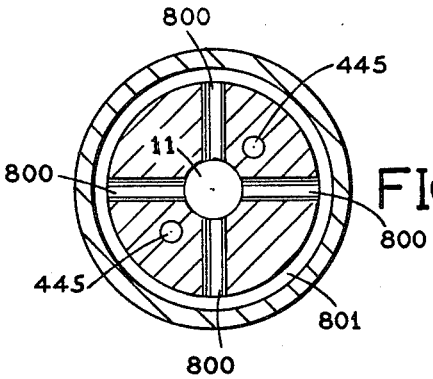
FIG. 8 shows a cross-sectional view of the top head of the power piston assembly and the holes that carry the production fluid. It is taken along line 8—8 of FIG. 4.

FIG. 8 shows the path for production fluid 11 flowing up chamber 801 into channel 800 and up chamber 700.

Figure 9:
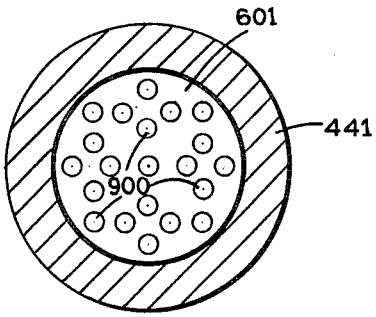
FIG. 9 is a cross-sectional view of the inlet strainer in the standing valve assembly taken along line 9—9 of FIG. 6.

FIG. 9 shows strainer 601 having holes 900.

Figure 10:
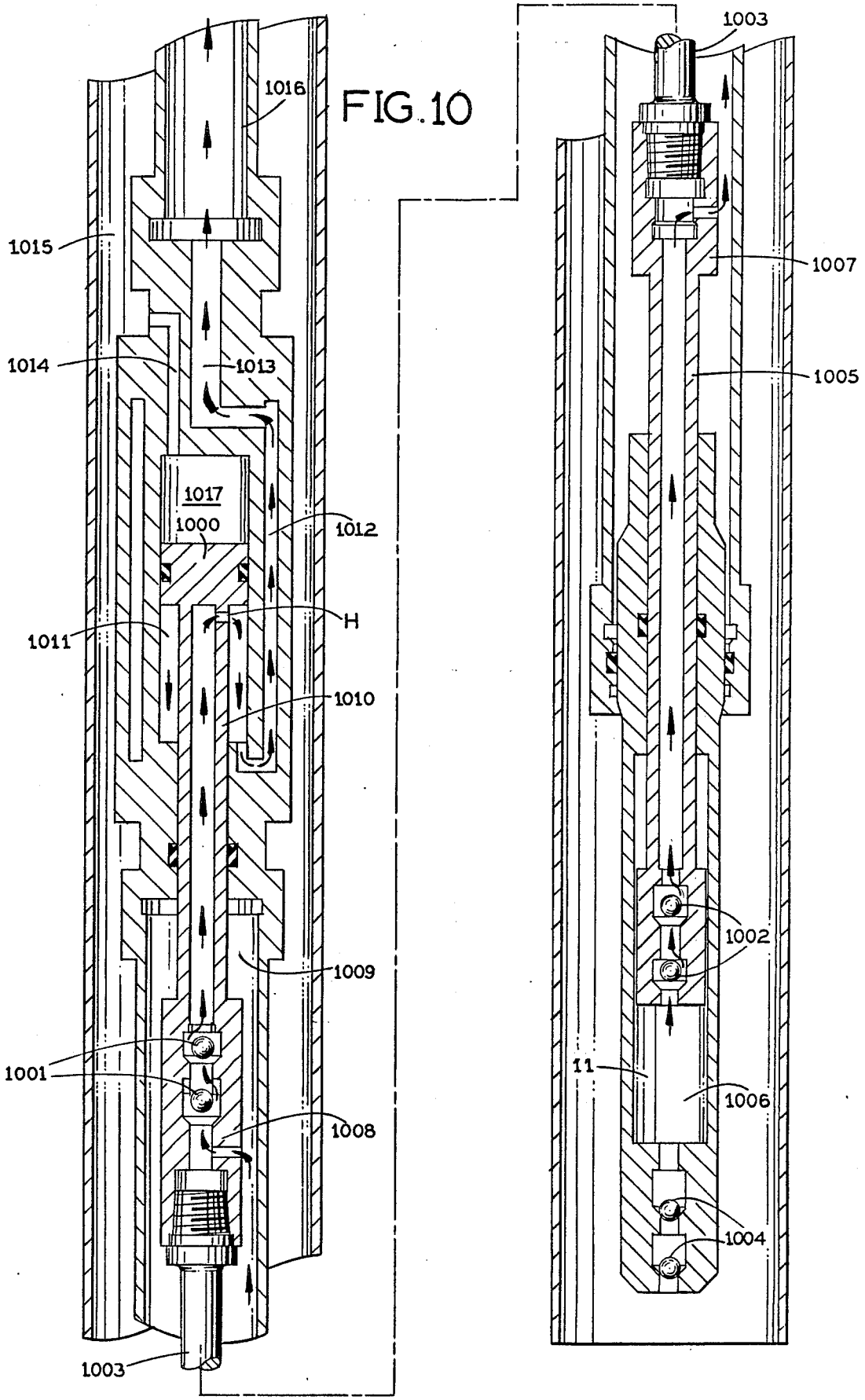
FIG. 10 is a schematic sectional view of the subsurface equipment in the middle of the down stroke.
Figure 11:
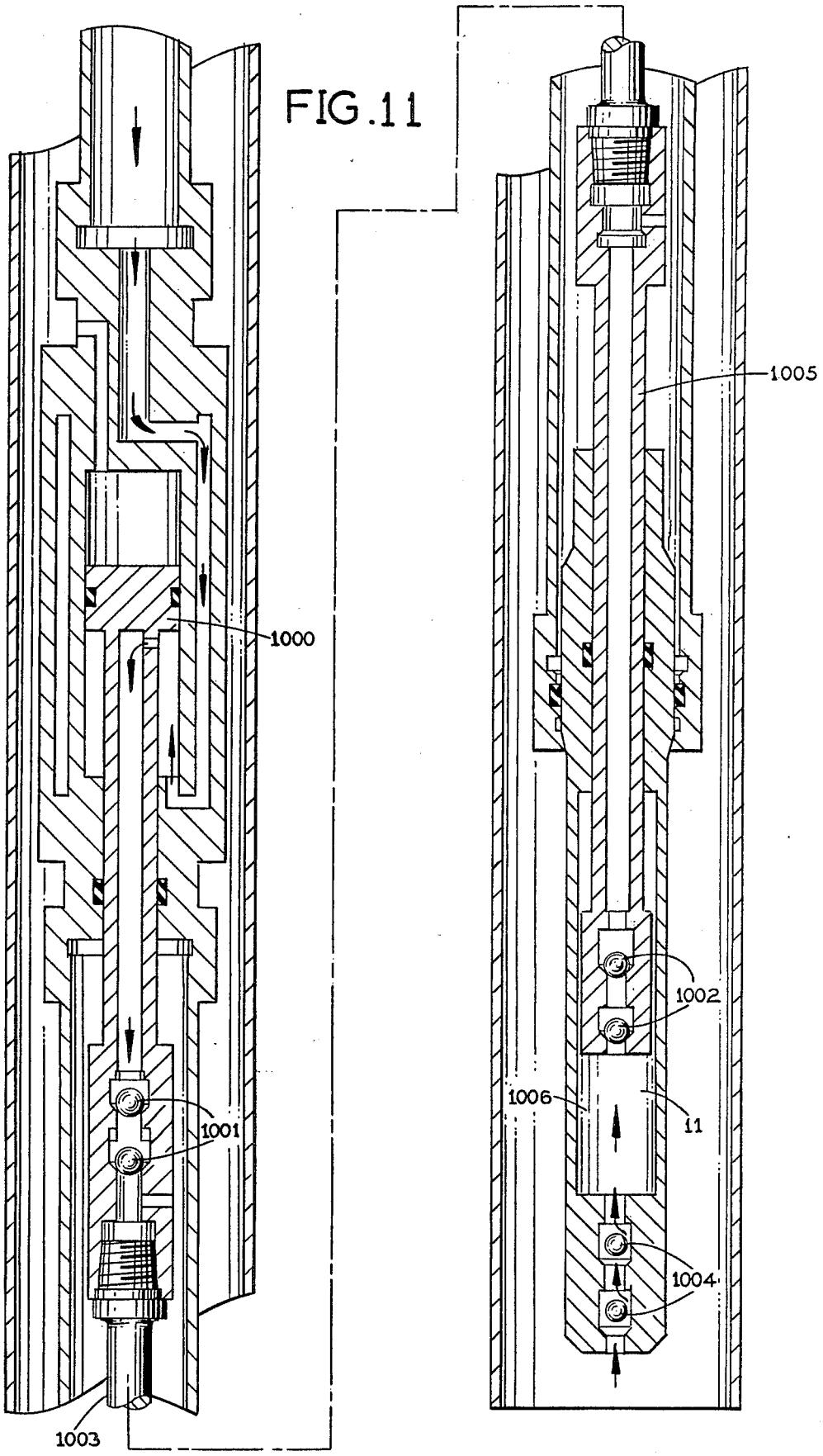
FIG. 11 is a schematic section view of the subsurface equipment in the middle of the up stroke.

FIG. 10 and 11 are schematic representations of the subsurface equipment to provide clarity of operation. The inlet strainer 601 and pipe are not shown. Different reference numbers are used since this is a schematic view.

FIG. 10 shows the subsurface equipment at the midpoint of the downstroke. In this mode, power piston 1000, sucker rod string 1003 and subsurface pump 1005 are travelling downward due to the force of gravity. The upper and lower sets of travelling valves 1001 and 1002 are open and the standing valve set 1004 is closed. The production fluid 11 in cavity 1006 is at well depth pressure and is flowing through travelling valve 1002. The production fluid 11 then travels up the center hole of subsurface pump plunger 1005 and exits through holes in coupling 1007 into cavity 1009. The fluid travels up cavity 1009 until it reaches the holes in coupling 1008. (Cavity 1009 is neutral, that is, no displacement of the production fluid 11 occurs). The production fluid 11 then flows through travelling valve set 1001 and up the center hole of power piston extension 1010. The production fluid 11 exits through holes H in power piston extension 1010 into cavity 1011. From there the production fluid 11 flows to annulus 1012. The production fluid 11 that had previously been forced downhole by the surface mounted actuator also flows up through annulus 1012. The combined fluid then flows through passage 1013 and exits to fluid column 1016 on its way to the surface. Cavity 1017 is vented to annulus 1015 through holes 1014. Annulus 1015 is the area between the production tubing and the casing of the well.

FIG. 11 shows the subsurface equipment at the midpoint of the upstroke. In this mode, power piston 1000, sucker rod string 1003 and subsurface pump 1005 are raised by the pressure pulse from the surface mounted actuator. The pressure pulse extends downhole only to travelling valve set 1001. (Functionally, travelling valve set 1001 is not required. Its purpose is to increase efficiency by blocking the pressure pulse so the production tubing below this point is not subjected to this pressure that slightly expands the production tubing. This slight expansion of the production tubing requires increased displacement of the actuator and thus the hydraulic actuation system). Travelling valve sets 1001 and 1002 are closed on the upstroke. Standing valve set 1004 is open so production fluid 11 from the formation can flow from the formation into cavity 1006.

Figure 2A:
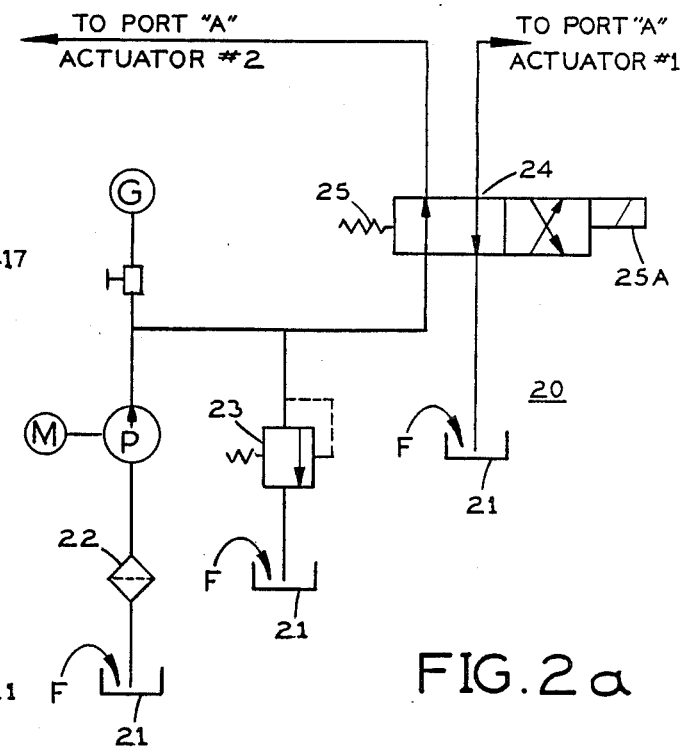

FIG. 2*a* shows a connection arrangement of the 4-way valve 24 so one hydraulic actuation system can be used to operate two proximate wells. One outlet port of the valve is connected to one actuator and the other outlet port is connected to a second actuator. The two actuators are used to provide pressure pulses to two wells. This further increases the efficiency of the system since the same size motor and pump can be used to recover fluid from two wells, usually without reducing the production from either well. The motor is operated in the "no load" mode when the hydraulic oil from the pump is being returned to the reservoir as in FIG. 2. This "no load" motor operation requires approximately 65 percent of the electrical power as when operating in the "full load" mode. Since the motor operates in the "no load" mode for approximately 50 percent of the time when no useful work is being performed with a single well, the electrical power savings are obvious since useful work is being performed nearly 100 percent of the time with little extra electrical power being consumed.

I claim:

1. A subsurface production fluid lifting system for underground formations, comprising:

a subsurface pump affixed at the production fluid level of the underground formation;

said subsurface pump connected to a power piston having a top and underside by a sucker rod string;

wherein said power piston is of such diameter and displaced a distance above said pump so the weight of said sucker rod string is nearly balanced by fluid column pressure of the production fluid on the underside of said piston;

and said top of said power piston is vented to the annulus between the production tubing and well casing;

wherein said power piston is powered upward by pressure pulses of the production fluid being pumped to the underside of said power piston;

wherein said pulses are generated from a surface mounted actuator having a free-body piston; and wherein said power piston will downstroke due to gravity between said pressure pulses;

and a check valve in the actuator having hydraulic connections to a storage area and to the production tubing and operative to direct production fluid to the storage area during each stroke of said free-body piston of said actuator in one direction, and operative to direct production fluid from said actuator down through the production tubing to said power piston for downhole powering the power piston during each stroke of the free-body piston in the opposite direction.

2. The system of claim 1 and further comprising means for actuation of said actuator.

3. A subsurface production fluid lifting system for underground formations, comprising:

a subsurface pump;

said subsurface pump affixed at the production fluid level of the underground formation;

prodution tubing extending from ground level down to said subsurface pump;

a subsurface power piston vertically reciprocable inside said production tubing above said subsurface pump;

sucker rods inside said production tubing extending from said subsurface power piston down to said subsurface pump;

said sucker rods connecting said subsurface power piston to said subsurface pump;

said subsurface pump having a reciprocating plunger connected to the lower end of said sucker rods whereby said subsurface piston powers said reciprocating plunger for pumping the production fluid up through said production tubing to ground level;

and means for power said vertical reciprocation of said subsurface power piston comprising a surface mounted hydraulic actuator operatively connected to said production tubing to deliver hydraulic pulses of the production fluid down through said production tubing to said subsurface power piston, said actuator having a double sided free-body piston slidingly reciprocable inside a chamber, whereby said free-body piston generates said hydraulic pulses, thereby powering said power piston;

means for powering said actuator to move said free-body piston to produce pressure pulses in the subsurface production fluid, thereby lifting said power piston; and said actuator further comprising a check valve in hydraulic communication with said free-body piston and with a storage area and with said production tubing, said check valve being operative to direct the production fluid up from said production tubing to the storage area during each stroke of said free-body piston in one direction and operative to direct the production fluid from said actuator down through said production tubing to said subsurface power piston for downhole powering the power piston during each stroke of the free-body piston in the opposite direction.

4. The subsurface production fluid lifting system of claim 3, wherein said subsurface power piston is biased upwards by pressure pulses from the surface.

5. The subsurface production fluid lifting system of claim 4, wherein said pressure pulses are limited to the depth of said power piston.

6. The subsurface production fluid lifting system of claim 4, wherein said power piston is slidingly engaged inside a cylinder having a tubing member to direct said pressure pulses to the bottom side of said power piston without pressurizing the top of said power piston.

7. The subsurface production fluid lifting system of claim 3, wherein the top of said power piston is vented.

8. The subsurface production fluid lifting system of claim 3, wherein said power piston further comprises a dashpot, thereby decelerating said power piston on the down stroke.

9. The subsurface production fluid lifting system of claim 3, wherein said reciprocating plunger, said power piston and said sucker rod are biased downward by gravity against the production fluid pressure.

10. The subsurface production fluid lifting system of claim 9, wherein said downward stroke of the reciprocating plunger, the power piston and the connecting sucker rods lifts the production fluid toward ground level.

11. The subsurface production fluid lifting system of claim 3, wherein said free-body piston is biased in said opposite direction by hydraulic fluid pressure and in the said one direction by spring force.

12. The subsurface production fluid lifting system of claim 3, wherein said free-body piston further comprises sealing packings which are axially disposed a distance greater than the stroke of the free-body piston.

13. The subsurface production fluid lifting system of claim 3, wherein said check valve further comprises means for actuation by said actuator.

14. The subsurface production fluid lifting system of claim 3, wherein said means for powering said actuator comprises an hydraulic actuation system for powering one side of said free-body piston with refined hydraulic fluid.

15. The subsurface production fluid lifting system of claim 14, wherein said free-body piston acts as a membrane member between the refined hydraulic fluid and the production fluid.

16. The subsurface production fluid lifting system of claim 14, wherein said chamber further comprises a port located at the midstroke of said free-body piston, thereby venting any leakage of the refined hydraulic fluid and the production fluid.

17. The subsurface production fluid lifting system of claim 14, wherein said hydraulic actuation system further comprises a pump and directional valve, whereby said directional valve alternately directs said refined hydraulic fluid to one side of the free-body piston and then to a reservoir for the hydraulic actuation system.

18. The subsurface production fluid lift system of claim 14, wherein said hydraulic actuation system further comprises a pump and directional valve, whereby said directional valve directs said refined hydraulic fluid alternately to one side of two separate free-body pistons thereby operating two proximate wells.

19. The subsurface production fluid lifting system of claim 17, wherein said directional valve further comprises adjustable timing means, whereby said adjustable times function to:

(a) allow the downstroke speed of the subsurface pump, subsurface power piston and sucker rod to be naturally determined by the specific gravity of the production fluid, and (b) allow stresses in the sucker rod to settle to their static state after the downstroke, and (c) to control the recovery rate of production fluid from the underground formation in order to prevent the settling out of sand in the production fluid.

* * * * *